US006722602B2

(12) United States Patent
Mims

(10) Patent No.: US 6,722,602 B2
(45) Date of Patent: Apr. 20, 2004

(54) CABLE MANAGEMENT SYSTEM

(75) Inventor: A J Mims, Huntington Beach, CA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 10/175,438

(22) Filed: Jun. 18, 2002

(65) Prior Publication Data

US 2003/0230662 A1 Dec. 18, 2003

(51) Int. Cl.[7] ..... A65H 75/38
(52) U.S. Cl. ..... 242/388.6; 242/901; 191/12.2 R
(58) Field of Search ..... 242/388.6, 901, 242/378.1, 378.2, 378.3, 378.4, 388.9, 388.91; 191/12 R, 12.2 R, 12.2 A, 12.4

(56) References Cited

U.S. PATENT DOCUMENTS

| | | | | | |
|---|---|---|---|---|---|
| 3,145,725 | A | * | 8/1964 | Knights | 242/388.6 |
| 3,169,719 | A | * | 2/1965 | Babacz | 242/388.6 |
| 3,773,987 | A | | 11/1973 | Davis et al. | |
| 4,436,190 | A | | 3/1984 | Wentzell | |
| 4,542,858 | A | | 9/1985 | Manges | |
| 5,058,819 | A | | 10/1991 | Lacour | |
| 5,279,469 | A | | 1/1994 | Foit | |
| 5,385,314 | A | | 1/1995 | Hughes | |
| 5,419,508 | A | | 5/1995 | Pierce | |
| 5,526,997 | A | * | 6/1996 | Karczmer | 191/12.2 R |
| 5,551,545 | A | | 9/1996 | Gelfman | |

FOREIGN PATENT DOCUMENTS

| | | | | |
|---|---|---|---|---|
| DE | 3901063 A1 | * | 7/1990 | 242/901 |

* cited by examiner

*Primary Examiner*—John M. Jillions
(74) *Attorney, Agent, or Firm*—Harness Dickey & Pierce P.L.C.

(57) ABSTRACT

A cable management system and method for winding on or letting out a length of cable from a cable support apparatus, in a generally curved, figure eight path, to prevent continuous twisting of a fixed length of cable coupled between the cable support apparatus and a fixed device. A control system is used to move the cable support apparatus in the figure eight path. The cable support apparatus includes a pair of spools which are arranged at a generally 45° angle to one another. Cable is alternately wound onto or wound from the two spools as the apparatus is moved in the figure eight path.

11 Claims, 2 Drawing Sheets

FIG 1
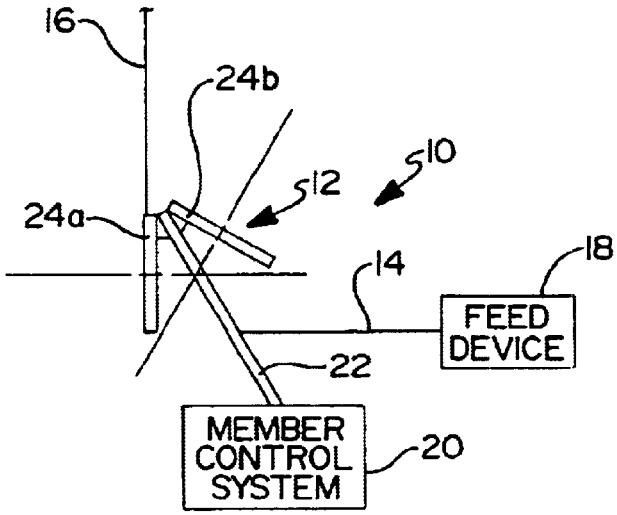
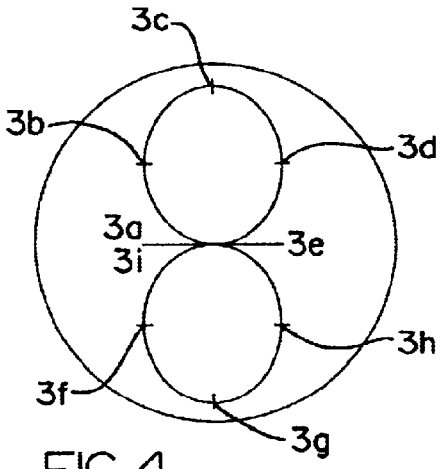
FIG 4
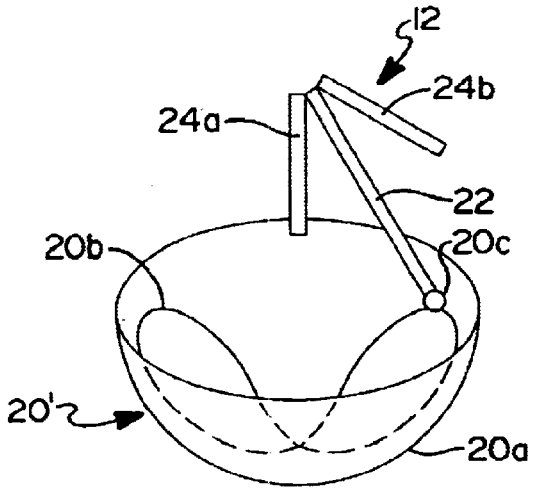
FIG 2

FIG 3a
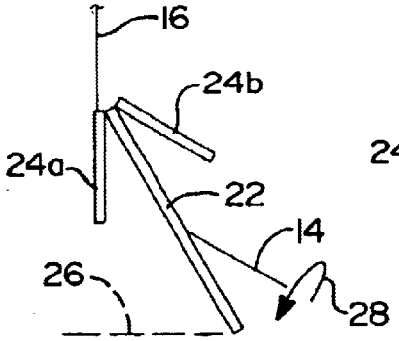
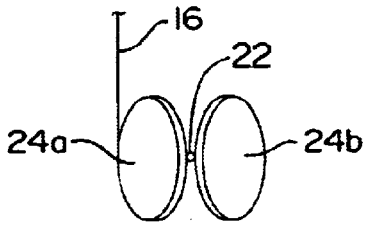
FIG 3b
FIG 3c
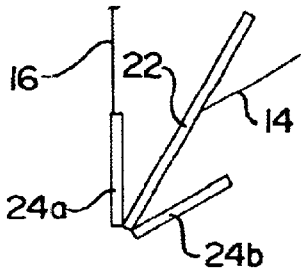
FIG 3d
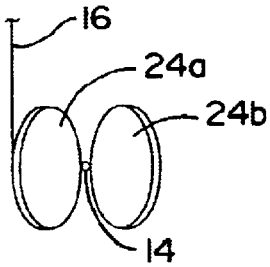
FIG 3e
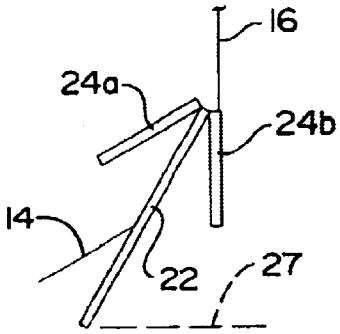
FIG 3f
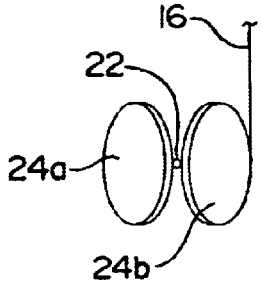
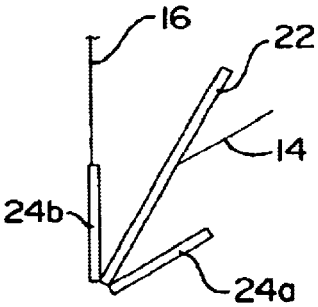
FIG 3g
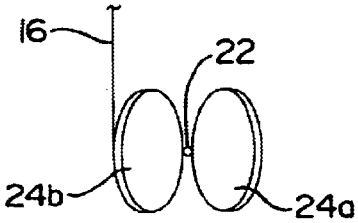
FIG 3h
FIG 3i
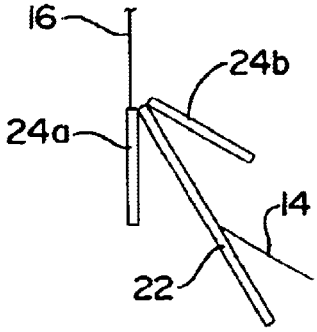

CABLE MANAGEMENT SYSTEM

FIELD OF THE INVENTION

This invention relates to take up assemblies and mechanisms for supporting lengths of various types of cable, and more particularly to a cable management system which allows a length of cable to be wound thereonto or wound therefrom without causing continuous twisting of a fixed length of cable coupling the system to an external device.

BACKGROUND OF THE INVENTION

Various devices and methods have been employed for supporting a length of cable in a manner which allows the cable to be wound thereon or unwound therefrom such that the cable can be extended from, or retracted on, the apparatus. One specific application where such devices are needed is with the winding and playing of electrical or fiber optic cables. Often such cables need to be extended to a remote location which is some distance from the location where the apparatus is positioned, while still maintaining a connection of the apparatus via a fixed length of cable to an external device located at the first location. The use of the fixed length of cable allows communication signals or power signals, or other forms of data or information, to be transmitted from the external device along the fixed cable to the main cable of the system or apparatus.

As will be appreciated, a problem arises as the cable supported by the apparatus, which is typically rolled up onto a drum or other like component, is wound or unwound therefrom. A fixed length of cable attached to the drum needs to be able to rotate about its longitudinal axis to prevent the fixed length of cable from continuously twisting as the main cable is wound onto or unwound from the drum or other like component. Without some means for preventing continuous twisting of the fixed length of cable, the fixed length of cable must be periodically detached, allowed to untwist, and then reattached, to the external device as the drum or other like component holding the main length of cable is rotated.

Accordingly, there is a need for a cable management system which allows a main length of cable to be wound thereon or let out therefrom without causing continuous twisting of a fixed length of cable coupling the system to an external fixed device which is supplying power, electrical signals, optical signals or other information to the main cable.

SUMMARY OF THE INVENTION

The present invention is directed to a cable management system and method which enables a main length of cable to be wound thereon or let out therefrom without causing continuous twisting of a fixed length of cable coupled between the apparatus and a fixed, external device which supplies signals through the fixed length of cable. The system generally includes a pair of spools arranged non-parallel to one another upon which a main length of cable is supported. A fixed length of cable extending from the spools is coupled to an external device which supplies power, electrical signals, optical signals or any other form of data or information to the main length of cable supported on the spools. A member coupled to the spools supports the spools in free space.

The member is used during a cable winding or cable let out process to move the spools in a figure eight path in free space. More specifically, a first one of the spools is moved orbitally about a first axis for approximately one 360 degree revolution and then the member reorientates the system such that a second one of the spools is oriented for orbital movement about a second axis of rotation which is parallel to the first axis of rotation. The second spool is rotated for approximately one 360 degree revolution about the second axis. The member causes an alternating re-orientation of the spools such that the spools are alternately rotated about their respective axes of rotation for one 360° revolution during the cable winding or cable let out process. As mentioned above, this causes the spools to effectively move in a figure eight path in free space during a winding or let out process.

In one preferred embodiment the spools are arranged at approximately a 45 degree angle relative to one another. In this embodiment the member which is used for rotating the spools is fixedly attached to the spools and extends from a connection point inbetween the two spools. The member is moved in the above-described figure eight pattern in free space to effect the winding or let out of the main length of cable to/from the spools.

In one preferred form a robot is used to move the member in the above-described figure eight path. In another embodiment a sphere having a figure eight track and an element disposed for movement in the figure eight track is used to control movement of the member supporting the spools.

It is a principal advantage of the present invention that during one 360 degree movement of a first one of the spools, the fixed length of cord is twisted in one rotational direction, and then during a subsequent 360 degree rotation of the other spool, the fixed cable is twisted in the opposite direction. This prevents continuous twisting of the fixed length of cable in one direction without the need for any form of complex electromechanical coupling between the fixed length of cable and the main length of cable supported on the spools. Thus, the fixed length of cable never continuously twists in one direction but rather alternately twists and untwists as the spools are rotated about their rotational axes.

Further areas of applicability of the present invention will become apparent from the detailed description provided hereinafter. It should be understood that the detailed description and specific examples, while indicating the preferred embodiment of the invention, are intended for purposes of illustration only and are not intended to limited the scope of the invention.

BRIEF DESCRIPTION OF THE DRAWINGS

The present invention will become more fully understood from the detailed description and the accompanying drawings, wherein:

FIG. 1 is a diagram of a cable management system in accordance with a preferred embodiment of the present invention illustrating a fixed length of cable coupled to a cable support apparatus and to a fixed device, a length of main cable extending from the cable support apparatus, and a member control system for moving the cable support apparatus in a figure eight path in free space;

FIG. 2 is a simplified illustration of an alternative preferred form of the member control system of FIG. 1 involving the use of a member which travels in a figure eight track formed within a spherical support element to achieve the needed figure eight motion of the cable support apparatus;

FIGS. 3*a*–3*h* show the cable support apparatus at various points of movement about a figure eight path during a cord winding process; and FIG. 4 is a perspective representation of the Figure eight path of movement of the cable support apparatus shown in FIG. 3.

DETAILED DESCRIPTION OF THE PREFERRED EMBODIMENTS

The following description of the preferred embodiment(s) is merely exemplary in nature and is in no way intended to limit the invention, its application, or uses.

Referring to FIG. 1, there is shown a cable management system 10 in accordance with a preferred embodiment of the present invention. The cable management system 10 generally includes a cable support apparatus 12 having a fixed length of cable 14 extending therefrom and a main length of cable 16. One end of the fixed length of cable 14 is coupled to a fixed device or component 18 which supplies power, electrical signals or other forms of signals and/or data or information through the fixed cable 14. The opposite end of fixed cable 14 communicates with the main length of cable 16. A member control system 20 is operably coupled to an elongated member 22 of the cable support apparatus 12. The member 22 extends from inbetween a pair of spools 24*a* and 24*b* of the cable support apparatus 12 that are coupled fixedly to each other at an angle non-parallel to each other. In one preferred form the spools 24*a* and 24*b* extend at an angle of about 45° from one another, with the member 22 extending at an angle of about 22.5° from each of the spools 24*a* and 24*b*. The spools 24*a*, 24*b* are fixedly coupled to the member 22 and these three components cooperatively form the cable support apparatus 12, together with the fixed cable 14 and the main length of cable 16.

The member control system 20 is used to move the cable support apparatus 12 in a curving, figure eight path in free space to effect either a take up of the main length of cable 16 onto the spools 24*a* and 24*b* during a cable take up process, or to enable the main length of cable 16 to be let out ("played") from the spools 24*a*, 24*b* during a cable let out process. Importantly, take up or letting out of the main length of cable 16 is accomplished via the FIG. eight path of movement of the apparatus 12 without causing continuous twisting in one direction of the fixed length of cable 14. The member control system 20 may comprise a robot, robotic system or other suitable form of control system which manipulates the member 22 to provide the required curved, figure eight motion to the cable support apparatus 12.

Referring briefly to FIG. 2, an alternative preferred embodiment 20' of the member control system 20 is shown. The system 20' of FIG. 2 involves the use of a semi-spherical support 20*a* having a curving figure eight track 20*b* formed therein. An element 20*c*, such as a carriage or other form of element capable of being attached to the member 22, is secured to the track 20*b* and rides therein in a figure eight path to cause movement of the cable support apparatus 12 in the needed figure eight motion. It will be appreciated that virtually any form of robotic or non-robotic control system capable of employing a generally curving, figure eight motion to the member 22 of the cable support apparatus 12 could be employed to effect the required movement of the cable support apparatus 12.

Referring now to FIGS. 3*a*–3*i*, the movement of the cable support apparatus 12 in its figure eight path during a cable take up process is illustrated. It will be appreciated immediately, however, that reversing the following steps will effect the cable let out operation. FIG. 4 also illustrates the points of travel on the figure eight path that correspond to each of FIGS. 3*a*–3*i*.

Initially, the cable support apparatus 12 is moved via member 22 orbitally about first axis 26 in accordance with directional arrow 28. Continued movement of the apparatus 12 in accordance with arrow 28 is represented by FIGS. 3*b*–3*e*. FIG. 3*b* illustrates the apparatus 12 after 90° of rotation from rotation from that of FIG. 3*a*. FIGS. 3*d* and 3*e* illustrate the orientation of the apparatus 12 at 270° and 360° degrees of movement, respectively, from the position shown in FIG. 3*a*. These points are denoted by Legends "3*a*"–"3*e*" of FIG. 4, which illustrates the curving figure eight path that the cable support apparatus 12 follows during a cable let out or cable take up process.

FIGS. 3*e*–3*i* illustrate the second 180° path of travel of the cable support apparatus 12. During this phase of movement the spool 24*b* is rotated about axis 27 which is essentially parallel to axis 26. Important to note is that the main length of cable 16 is looped from spool 24*a* and onto spool 24*b* at approximately the 180° point of travel of the apparatus 12. This happens automatically due to the positioning of the spool 24*b*. Thus, from FIGS. 3*e*–*h*, the main length of cable 16 is wound onto spool 24*b*. At FIG. 3*i*, which represents the starting point shown in FIG. 3*a*, the main length of cable 16 has again been looped onto spool 24*a*. Again, this happens automatically due to the positioning of spool 24*a*.

Thus, the main length of cable 16 is alternately looped for one 360° movement of the apparatus 12 onto first one of the spools 24*a* and or 24*b*, and then onto the opposite spool for the subsequent 360° movement of the apparatus 12. Importantly, moving the apparatus 12 in this generally curving, figure eight path prevents the fixed length of cable 14 from being wound continuously in one direction during the cable take up or cable let out process. This is because during the first 360° of rotation represented by FIGS. 3*a*–3*e*, the fixed cable 14 is twisted in a first rotational direction, while during the second 360° phase of movement of the apparatus 12 between FIGS. 3*e* and 3*i*, the fixed cable 14 is rotated in the opposite rotational direction. Thus, the fixed length of cable 14 is alternately twisted and untwisted as the cable support apparatus 12 is continuously rotated during the cable take up or let out process. The curving figure eight path is shown in FIG. 4.

The cable support apparatus 12 thus functions to allow the main length of cable 16 to be wrapped onto (or let out from) the spools 24*a* and 24*b*, in alternating fashion, and further in a pattern (i.e., a generally curved, figure eight pattern) which effectively causes twisting of the fixed cable 14 in alternating rotational directions. The cable management system 10 thus does not require complicated and/or costly additional components needed to compensate for the continuous twisting of a fixed cable that would otherwise occur with conventional drum-type cable support systems.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. A cable management apparatus comprising:

a cable take-up apparatus for holding a length of cable thereon, said take-up apparatus including:

a first spool section;

a second spool section disposed adjacent to said first spool section and being arranged non-parallel to said first spool section;

a member extending non-parallel to said first and second spools and having a first length of said cable extending from said take-up apparatus adapted to be secured to a structure remote from said take-up apparatus;

said first and second spool sections cooperatively supporting a second length of said cable to be one of wound therefrom during a cable let out process and wound thereon during a cable take up process; and a mechanism associated with said spool sections for moving said spool sections in a figure eight path in space such that said first spool section and second spool section are alternately rotated for approximately 360 degrees of movement each, thereby enabling said second length of cable to be alternately wound off of or onto each said spool section, one revolution at a time from each said spool section, without causing continuous twisting of said first length of cable in one direction as said second length of said cable is wound or unwound from said spool sections.

2. The cable management apparatus of claim 1, wherein said mechanism comprises a robot for manipulating said member.

3. The cable management apparatus of claim 1, wherein said mechanism comprises a partial sphere having a moving element which moves in said figure eight path, said moving element being operably coupled to said member to thereby move said member in said figure eight path in said space.

4. The cable management apparatus of claim 1, wherein said member is coupled to said cable take-up apparatus in between said spool sections.

5. The cable management apparatus of claim 1, wherein said spool sections are arranged at approximately a 45 degree angle to one another.

6. A cable management apparatus comprising:

a cable take-up apparatus for holding a length of cable thereon, said cable take-up apparatus including:

a first spool movable about a first axis of rotation;

a second spool movable about a second axis of rotation and being disposed adjacent to said first spool and being non-parallel to said first spool;

a first length of said cable extending from said take-up apparatus and adapted to be secured to a structure remote from said take-up apparatus;

said first and second spools cooperatively supporting a second length of said cable thereon; and a mechanism operably associated with said spools for moving said spools in a figure eight path in space such that said first spool and second spool are alternately moved about their respective axes of rotation after each 360 degrees of rotation of each said spool, and further such that said axes of rotation are arranged parallel to one another as said spools are alternately moved in said space, thereby enabling said second length of cable to be alternately wound onto or off of each said spool, one revolution at a time from each said spool, without causing continuous twisting of said first length of cable in one direction as said second length of said cable is wound or unwound from said spools.

7. The cable management apparatus of claim 6, wherein said mechanism comprises:

a member fixedly secured to said spools and extending non-parallel to said spools; and a robot for moving said member in said figure eight path in said space.

8. The cable management apparatus of claim 6, wherein said mechanism comprises:

a member fixedly secured to said spools and extending non-parallel to said spools;

a semi-spherical support structure having a figure eight travel path defined therein; and a movable element supported by said semi-spherical support structure for movement along said figure eight travel path thereon, said movable element being coupled to said member to thereby move said spools in said figure eight path in said space.

9. The cable management system of claim 6, wherein a central axis of each of said spools is arranged at an approximate 45 degree angle to the other one of said spools.

10. The cable management system of claim 7, wherein said member is coupled to said spools at a point in between said spools so as to extend non-parallel to each of said spools.

11. A method of performing at least one of a winding process and an unwinding process of a cable associated with a cable support structure, said method comprising:

providing a first length of said cable which is fixedly secured at one end to a structure remote from said cable support structure, and at a second end to said cable support structure;

forming first and second independent spool sections on said cable support structure for cooperatively supporting a second length of said cable;

disposing said independent spool sections at a non-parallel orientation relative to each other;

moving said cable support structure such that said first spool section is moved in free space for approximately one 360 degree revolution about a first axis of rotation to thereby let out, or wind thereon, a first subportion of said second cable;

reorienting said cable support structure such that said second spool section is able to be moved in said free space about a second axis of rotation generally parallel to said first axis of rotation;

moving said second spool section in said free space about said second axis of rotation for approximately one 360 degree revolution, to thereby let out, or wind thereon, a second subportion of said second cable; and alternately reorienting said spool sections such that successive subportions of said second cable are alternately wound on said spool sections, said alternate reorienting of said spool sections further operating to prevent continuous twisting of said first length of said cable in one direction as said spool sections are alternately rotated about their respective said axes of rotation.

* * * * *